US008858871B2

(12) United States Patent
Dourfaye et al.

(10) Patent No.: US 8,858,871 B2
(45) Date of Patent: Oct. 14, 2014

(54) PROCESS FOR THE PRODUCTION OF A THERMALLY STABLE POLYCRYSTALLINE DIAMOND COMPACT

(75) Inventors: Alfazazi Dourfaye, Paris (FR); William King, Houston, TX (US)

(73) Assignee: Varel International Ind., L.P., Carrollton, TX (US)

( * ) Notice: Subject to any disclaimer, the term of this patent is extended or adjusted under 35 U.S.C. 154(b) by 37 days.

(21) Appl. No.: 12/252,145

(22) Filed: Oct. 15, 2008

(65) Prior Publication Data

US 2009/0032169 A1 Feb. 5, 2009

Related U.S. Application Data

(63) Continuation-in-part of application No. 12/056,595, filed on Mar. 27, 2008.

(30) Foreign Application Priority Data

Mar. 27, 2007 (FR) ..... 07 54061

(51) Int. Cl.
*B22F 7/00* (2006.01)

(52) U.S. Cl.
USPC ..... 419/9; 419/14; 419/29

(58) Field of Classification Search
USPC ..... 175/426; 164/332; 419/9, 14, 27
IPC ..... B22F 3/26; C22C 26/00,29/08
See application file for complete search history.

(56) References Cited

U.S. PATENT DOCUMENTS 3,745,623 A 7/1973 Wentorf, Jr. et al.
4,225,322 A 9/1980 Knemeyer (Continued)

FOREIGN PATENT DOCUMENTS

DE 31 12 460 A1 9/1982
DE 203 750 11/1983

(Continued)

OTHER PUBLICATIONS

Park et al. ("Anomalous growth of the Complex Carbide Phase in Carbon-Deficient WC—Co hard Metal During the Infiltration of Eutectic Liquid", Mater. Sci. Eng. A Struct. Mater. Prop. Microstruct. Process, Nov. 1988, vol. A105-6, No. part 1, Nov. 9, 1987, pp. 233-236).*

(Continued)

*Primary Examiner* — Weiping Zhu
(74) *Attorney, Agent, or Firm* — Gardere Wynne Sewell LLP; Andre M. Szuwalski

(57) ABSTRACT

In a process, a thermally stable diamond table body and a substrate are stacked on each other at an interface which includes a layer of a imbibiting material interposed between a bottom surface of the body and an upper surface of the substrate. The stack is subjected to a suitable thermal cycle, constituted by heating, temperature maintenance and cooling, which brings at least some of the imbibiting material into the liquid state for migration into the thermally stable diamond table body and substrate at and about the interface so as to join the thermally stable diamond table body to the substrate. The substrate may be produced as a block of dense material constituted by hard particles dispersed in a binder phase, wherein the dense material has been enriched locally with binder phase by imbibition. Alternatively, imbibition material from the enriched substrate may be caused by the thermal cycle to migrate from the substrate into the diamond table body so as to join the thermally stable diamond table body to the substrate.

36 Claims, 6 Drawing Sheets

(56) References Cited

U.S. PATENT DOCUMENTS

| | | | | |
|---|---|---|---|---|
| 4,402,764 | A | 9/1983 | Clark et al. | |
| 4,548,786 | A | 10/1985 | Yohe | |
| 4,604,106 | A | 8/1986 | Hall | |
| 4,610,931 | A | 9/1986 | Nemeth et al. | |
| 4,664,705 | A | 5/1987 | Horton et al. | |
| 4,726,718 | A | 2/1988 | Meskin et al. | |
| 4,729,440 | A | 3/1988 | Hall | |
| 4,743,515 | A | 5/1988 | Fischer et al. | |
| 4,820,482 | A | 4/1989 | Fischer et al. | |
| 4,943,488 | A | 7/1990 | Sung et al. | |
| 5,011,514 | A | 4/1991 | Cho et al. | |
| 5,028,177 | A | 7/1991 | Meskin et al. | |
| 5,079,102 | A | 1/1992 | Tanaka et al. | |
| 5,111,895 | A | 5/1992 | Griffin | |
| 5,127,923 | A | 7/1992 | Bunting et al. | |
| 5,441,817 | A | 8/1995 | Rai | |
| 5,618,625 | A | 4/1997 | Okamura | |
| 5,645,617 | A | 7/1997 | Frushour | |
| 5,713,133 | A | 2/1998 | Bhat et al. | |
| 5,880,382 | A | 3/1999 | Fang et al. | |
| 5,889,219 | A | 3/1999 | Moriguchi et al. | |
| 6,054,693 | A | 4/2000 | Barmatz et al. | |
| 6,443,248 | B2 | 9/2002 | Yong et al. | |
| 6,562,462 | B2 * | 5/2003 | Griffin et al. | 428/408 |
| 6,620,375 | B1 | 9/2003 | Tank et al. | |
| 6,869,460 | B1 | 3/2005 | Bennett et al. | |
| 7,377,341 | B2 | 5/2008 | Middlemiss et al. | |
| 7,396,501 | B2 | 7/2008 | Pope et al. | |
| 7,487,849 | B2 | 2/2009 | Radtke | |
| 7,533,740 | B2 | 5/2009 | Zhang et al. | |
| 7,569,179 | B2 | 8/2009 | Fang | |
| 7,887,747 | B2 | 2/2011 | Iwasaki et al. | |
| 2002/0051848 | A1 | 5/2002 | Li | |
| 2002/0077054 | A1 | 6/2002 | Sung | |
| 2002/0096306 | A1 * | 7/2002 | Butcher et al. | 164/332 |
| 2004/0094333 | A1 * | 5/2004 | Yamamoto et al. | 175/426 |
| 2005/0050801 | A1 | 3/2005 | Cho et al. | |
| 2005/0230155 | A1 | 10/2005 | Sung | |
| 2005/0276717 | A1 | 12/2005 | Fang | |
| 2006/0060392 | A1 | 3/2006 | Eyre | |
| 2006/0254830 | A1 | 11/2006 | Radtke | |
| 2007/0131459 | A1 | 6/2007 | Voronin et al. | |
| 2007/0214913 | A1 | 9/2007 | Fang | |
| 2008/0142276 | A1 | 6/2008 | Griffo et al. | |
| 2008/0185189 | A1 | 8/2008 | Griffo et al. | |
| 2008/0223623 | A1 | 9/2008 | Keshavan et al. | |
| 2008/0230280 | A1 | 9/2008 | Keshavan et al. | |
| 2008/0240879 | A1 | 10/2008 | Dourfaye et al. | |
| 2009/0173547 | A1 | 7/2009 | Voronin et al. | |
| 2009/0226688 | A1 | 9/2009 | Fang | |
| 2010/0151266 | A1 | 6/2010 | Arvanitidis | |
| 2011/0042147 | A1 | 2/2011 | Fang et al. | |
| 2011/0174550 | A1 | 7/2011 | Colin et al. | |

FOREIGN PATENT DOCUMENTS

| | | | |
|---|---|---|---|
| EP | 1 975 264 | A1 | 10/2008 |
| GB | 2438073 | | 11/2007 |
| JP | 62 074076 | A | 4/1987 |
| WO | WO 93/08952 | | 5/1993 |
| WO | WO 2009/111749 | A1 | 9/2009 |

OTHER PUBLICATIONS

International Search Report and Written Opinion, PCT/US 09/60547, dated Dec. 14, 2009, 10 pages.

O. Eso, Z. Fang, A. Griffo, Liquid Phase Sintering of Functionally Graded WC—Co Composites, International Journal of Refractory Metals & Hard Materials 23 (2005) 233-241.

C. Colin, F. Delannay, Effect of Shape Accommodation on the Equilibrium Distribution of Liquid in Assemblies of WC/Co cermets, Proceedings 4th International Conference on Science, Technology and Applications of Sintering, 2005, 188-191.

Park Jong-Ku, et al., Anomalous Growth of the Complex Carbide Phase in Carbon-Deficient WC—Co Hard Metal During the Infiltration of Eutectic Liquid, Materials Science and Engineering, vol. A105-6, No. Part 1, (1998), pp. 233-236, Nov. 9, 1987, XP-002458195.

Roebuck et al., Infiltration as a Method for Producing WC Hardmetals with Co and Ni Alloy Binder-Phases, International Journal of Refractory and Hard Metals, MPR Publishing Services Ltd., Shrewbury, GB, vol. 3, No. 1, Mar. 1, 1984, pp. 35-40, XP 000569229, ISSN: 0263-4368.

Jain, et al., Processing of Functionally Graded WC/Co/Diamond Nanocomposites, Scripta Materialia, Elsevier, Amsterdam, NL, vol. 44, No. 8-9, May 18, 2001, pp. 2099-2103, XP004327717, ISSN: 1359-6462.

Preliminary French Search Report and Written Opinion, FR 07 54061, dated Nov. 12, 2007.

P. Cao, et al.: "Optimization Design and Residual Thermal Stress Analysis of PDC Functionally Graded Materials," J. Zhejiang Univ. Science A, 2006 7(8), pp. 1318-1323.

International Preliminary Report on Patentability mailed Apr. 28, 2011, for PCT/US2009/060547 (8 pages).

Sorlier, et al. "Elaboration de gradients de composition continue dans des taillants PDC" Materiaux 2006 Nov. 13-17, 2006—Dijon, France, 9 pages.

Sorlier, et al. "Elaboration de gradients de composition continue dans des taillants PDC" HAL: hal-00144546, version 1, http://hal.archives-ouvertes.fr/hal-00144546/en/, abstract, 2006.

International Search Report, International Application No. PCT/FR2009/051910, Jan. 29, 2010.

* cited by examiner

PROCESS FOR THE PRODUCTION OF A THERMALLY STABLE POLYCRYSTALLINE DIAMOND COMPACT

PRIORITY CLAIM

This application is a continuation-in-part of U.S. application for patent Ser. No. 12/056595 filed Mar. 27, 2008, which is a translation of and claims priority from French Application for Patent No. 07 54061 filed Mar. 27, 2007, the disclosures of which are hereby incorporated by reference.

BACKGROUND OF THE INVENTION

1 Technical Field of the Invention

The present invention relates to the production of thermally stable polycrystalline (TSP) diamond compacts in which a diamond table is attached to a substrate.

2 Description of Related Art

Drilling tools are constituted by bits surmounted by cutters for cutting or grinding materials such as rock. The cutters, which are the active part of the tool, are in most cases made with a substrate of carbide, an extremely hard but brittle material, mounted with a synthetic diamond table. The fragility of the cutter material is particularly disadvantageous when such tools are used to drill geological layers constituted by rocks of different hardness, it being possible for heterogeneities in the drilled formation to cause impacts which may give rise to cracks in the cutters and thus lead to wear of the bits by flaking or to breaking of the cutters.

In order to reduce the risks of premature wear or breaking of the cutters, it is known to create cutters with substrates made of cermet (ceramic metal composite), the core of which is more ductile than the outside surface. The core of the cutter will thus be more resistant to impacts (using a zone enriched with binder phase), while maintaining a good cutting ability (using a zone low in binder phase, which is in contact with the rock).

In order to produce such cutters, which are known as cutters having a composition gradient or property gradient called Functionally Graded Material (FGM), it has been proposed to produce non-dense cermets having a porosity gradient and to infiltrate with a binder phase in order to improve the ductility of a zone at the core of the cermet. However, that method is ill-suited, in particular to tungsten carbide-cobalt (WC-Co) systems, because it leads to the partial destruction of the carbide skeleton that exists prior to the infiltration and accordingly does not allow the desired properties of the cutter to be obtained.

It has also been proposed to produce cermets having a composition gradient, with a hard outside surface and a ductile core, by the natural sintering (without the application of external pressure) in solid phase of a multi-layer element, each of the layers having a different composition. However, that method does not allow the material to be densified completely and thus must be followed by an expensive hot isostatic compaction treatment. In addition, the preparation of the cermet having a composition gradient is complex because it requires the production of a series of elementary layers which fit one into the other, each layer having a different composition. Finally, that process, which is complex and very expensive, does not allow a continuous composition gradient to be obtained. Accordingly, a cermet so obtained comprises a succession of layers having substantially different hardnesses and coefficients of expansion, leading to the risk of delamination at the interface between two adjacent layers.

In order to remedy the disadvantages of solid-phase sintering, it has been proposed to produce such materials by natural liquid-phase sintering, which allows a material having a completely dense, gradual structure to be obtained very rapidly and in a single step. However, that process has the disadvantage of weakening the composition gradient quite considerably by virtue of the migration of liquid between the layers of small thickness. Furthermore, and wholly unexpectedly, the composition gradient remains discontinuous when the dwell time in the liquid state remains below a critical time beyond which complete homogenization of the cermet is noted.

For those various reasons, the previous methods are not suitable for the industrial manufacture of drilling tools having satisfactory use properties, both wear resistance at the surface and ductility or toughness at the core.

In addition, in order to improve the working life of cutting tools, it has been proposed to deposit hard coatings of nitride, carbonitride, oxide or boride on the surface of cermets. Such methods have been described, for example, in U.S. Pat. Nos. 4,548,786 or 4,610,931, the disclosures of which are hereby incorporated by reference. However, those methods have the disadvantage that they only improve the resistance of the cermet to wear by abrasion, and that improvement is achieved only over small thicknesses (several microns). Moreover, because the nature of the coating differs from that of the cutter, delamination or flaking of that layer at the interface between the cermet and the diamond table may occur following thermomechanical stress.

It has also been proposed to improve both the wear resistance of the surface and the impact resistance of cermets of the WC-Co type by bringing a cermet that is substoichiometric in terms of carbon into contact with a carbon-rich gaseous phase (methane). Under the effect of temperature, the carbon from the gaseous phase diffuses into the substoichiometric cermet and reacts with the η phase according to the chemical reaction $2C+Co_3W_3C$ (η phase)→$3WC+3Co$, resulting in the release of cobalt, which migrates towards the zones that are less rich in cobalt. However, that method, which is described, for example, in U.S. Pat. No. 4,743,515 (the disclosure of which is hereby incorporated by reference), has the disadvantage that it results in a binder phase gradient that is rich in cobalt over one or two millimeters, while the core of the cermet remains fragile because it is constituted by the η phase and can easily crack during repeated impacts.

It has also been proposed to produce cutting tools having specific structures, especially honeycombed structures, which have the advantage of combining good wear resistance and good toughness. Such cermets having a functional microstructure exhibit a compromise of ductile/fragile properties which is of interest but remains inadequate for the intended application. That composite material is the subject of U.S. Pat. No. 5,880,382 (the disclosure of which is hereby incorporated by reference).

In general, it is known to attach a polycrystalline diamond body (also referred to in the art as a diamond table) to a substrate using a combination of high pressure and high temperature (HPHT) to form a sintered polycrystalline diamond compact (PCD). The chemical bonds between the diamond table and the substrate are established during the sintering process by combinations of carbon bonds (in the diamond table) with substrate metal bonds. The mechanical fixation obtained is a result of: the shape of the substrate and diamond table, differences in the physical properties of the substrate and the diamond table, and the gradient interface between the substrate and the diamond table.

It is also known in the art to leach the diamond table in order to extend its abrasion resistance characteristics and provide thermal stability. Such a leaching operation typically removes the solvent metal catalyst (for example, cobalt) from all or a portion of the diamond table. However, the removal of the cobalt from the diamond table can adversely affect the ability to achieve a strong connection between the table body and the substrate.

Reference is made to U.S. Patent Application Publication No. 2008/0185189, dated Aug. 7, 2008, the disclosure of which is hereby incorporated by reference. This reference teaches a method for constructing a thermally stable ultra-hard compact which comprises a polycrystalline diamond body (also referred to in the art as a diamond table) that is mounted to a substrate. The polycrystalline diamond body is made of a thermally stable polycrystalline (TSP) diamond material, and the substrate is made of ceramic, metallic, or cermet material. Complementary interface surface features are provided on a back (bottom) surface of the polycrystalline diamond body and front (upper or top) surface of the substrate. These complementary interface surface features facilitate an improved degree of attachment between the polycrystalline diamond body and the substrate. An intermediate material (such as a braze material) is interposed between the back surface of the polycrystalline diamond body and front surface of the substrate to assist in joining the body to the substrate. A high pressure and high temperature (for example, brazing) treatment is then performed to effectuate the joining through the brazing material. The complementary interface surface features in combination with the intermediate brazing material form a strong connection between body and substrate so as to reduce or eliminate the possibility of delamination.

Imbibition is understood as being an enrichment with a liquid of a completely dense solid/liquid system in which at least a solid phase is in the form of grains able to adapt their form by absorption of liquid, thus making the system more stable energetically. The enrichment with liquid is made under the effect of the driving power resulting from the migration pressure existing in such systems. Infiltration is an enrichment with a liquid of a non completely dense solid/liquid system under only the driving power resulting from the capillarity action (also named capillary pressure). An impregnation involves a third phase named the non condensed phase (gaseous phase) in addition to the two condensed phases (solid/liquid).

SUMMARY OF THE INVENTION

In an embodiment, a process comprises: stacking a thermally stable diamond table body on a substrate at an interface which includes a layer of a first imbibiting material interposed between a bottom surface of the thermally stable diamond table body and an upper surface of the substrate; and subjecting the stacked thermally stable diamond table body and substrate to a thermal cycle, constituted by heating, temperature maintenance and cooling, which brings at least some of the first imbibiting material into the liquid state for migration into both the thermally stable diamond table body and substrate at and about the interface so as to join the thermally stable diamond table body to the substrate. Thus, the substrate is imbibed with the first imbibiting material from the layer and the thermally stable diamond table is infiltrated by the first imbibiting material from the layer.

The process further comprises forming the substrate by: providing a block of dense material constituted by hard particles dispersed in a binder phase, the block having at least one imbibition area on a surface thereof, bringing the imbibition area of the surface of the block into contact with a second imbibiting material having properties which support locally enriching the block with binder phase; and subjecting the block in contact with the second imbibiting material to a suitable thermal cycle, constituted by heating, temperature maintenance and cooling, which brings at least some of the second imbibiting material and the binder phase of the block into the liquid state, so as to locally and gradually enrich the dense material block with binder phase by imbibition through the imbibition area.

The substrate may comprise a cermet block of the WC-binder type, wherein the binder material is selected from the group consisting of Co, Ni and Fe, and wherein the first imbibiting material is made from the same binder material.

The substrate may comprise a tungsten carbide block, wherein the first imbibiting material is made from cobalt, and wherein the thermally stable diamond table body has been subjected to a cobalt leaching process which removes interstitial cobalt atoms.

In another embodiment, a process comprises: stacking a thermally stable diamond table body on a substrate at a first interface which includes a layer of a first imbibiting material interposed between a bottom surface of the thermally stable diamond table body and an upper surface of the substrate; stacking the substrate on an imbibition block formed of a second imbibiting material at a second interface with a lower surface of the substrate; and subjecting the stack of thermally stable diamond table body, substrate and imbibition block to a thermal cycle, constituted by heating, temperature maintenance and cooling, which brings at least some of the first imbibiting material into the liquid state for migration into both the thermally stable diamond table body and substrate at and about the interface so as to join the thermally stable diamond table body to the substrate, and which brings at least some of the second imbibiting material into a liquid state for migration into the lower surface of the substrate for local and gradual enrichment of the substrate.

In another embodiment, a process comprises: forming a substrate by: bringing an imbibition area on a surface of a block of dense material into contact with an imbibition block, the imbibition block formed of an imbibition material; and subjecting the dense material block and imbibition block to a first thermal cycle, constituted by heating, temperature maintenance and cooling, which brings at least some of the imbibition material into the liquid state for migration through the imbibition area surface of the substrate for local and gradual enrichment of the substrate. After the substrate is formed, the process further comprises: stacking a thermally stable diamond table body on the enriched substrate at an interface which includes a bottom surface of the thermally stable diamond table body and the imbibition area surface of the enriched substrate; and subjecting the stack of thermally stable diamond table body and enriched substrate to a second thermal cycle, constituted by heating, temperature maintenance and cooling, which brings at least some of the imbibiting material into the liquid state for migration from the enriched substrate into the thermally stable diamond table body through the second interface so as to join the thermally stable diamond table body to the enriched substrate.

In yet another embodiment, a process comprises: forming a stack comprising a diamond table with a lower surface adjacent an upper surface of a substrate at an interface; and subjecting the stack to a thermal cycle including heating, temperature maintenance and cooling in order to cause migration of atoms of an imbibiting material into the diamond table through the interface so as to join the diamond table to the substrate.

The process further comprising locally and gradually enriching the substrate through either the upper or lower surface of the substrate with binder phase by imbibition. The process for enriching comprises placing an imbibition material into contact with the surface of the substrate at an imbibition area; and subjecting the substrate and imbibition material to a thermal cycle including heating, temperature maintenance and cooling which brings at least some of the imbibition material into the liquid state for migration through the imbibition area of the substrate for local and gradual enrichment of the substrate.

The process further includes providing a layer of the imbibition material at the interface between the lower surface of the diamond table and the upper surface of the substrate, the thermal cycle causing imbibiting material atoms to migrate from the layer into the diamond table and substrate.

Alternatively, when the upper surface of the substrate includes an enriched concentration of imbibiting material atoms at and near the interface with the lower surface of the diamond table, the thermal cycle causes imbibiting material atoms to migrate from the enriched substrate into the diamond table.

BRIEF DESCRIPTION OF THE DRAWINGS

The present invention will now be described in greater detail, but without implying any limitation, with reference to the appended drawings, in which.

DETAILED DESCRIPTION OF THE DRAWINGS

Figure 1A:
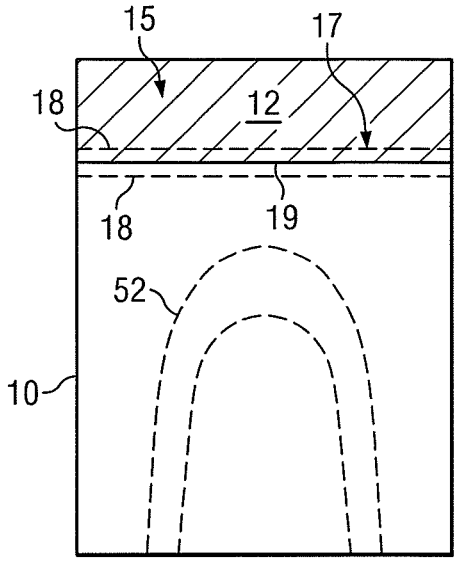
FIG. 1A illustrates a cross-section of a cutter for a drilling tool constituted by a substrate to which a diamond tip has been secured through an imbibition process.

Reference is now made to FIG. 1A which illustrates a cross-section of a cutter for a drilling tool constituted by a substrate 10 to which a diamond body 12 has been secured through an imbibition process. A polycrystalline diamond body (also referred to in the art as a diamond table or diamond tip) 12 is mounted to an upper surface of the substrate 10. The polycrystalline diamond body 12 is made of a thermally stable polycrystalline (TSP) diamond material, and the substrate 10 may be made of ceramic, metallic, or cermet (ceramic metal composite) material. The substrate 10 may alternatively comprise a functionally graded dense sintered cermet block as described herein (this being indicated by the dotted lines 52; see, also, FIG. 1C and the lines 52 of gradient change in binder phase content).

Figure 1B:
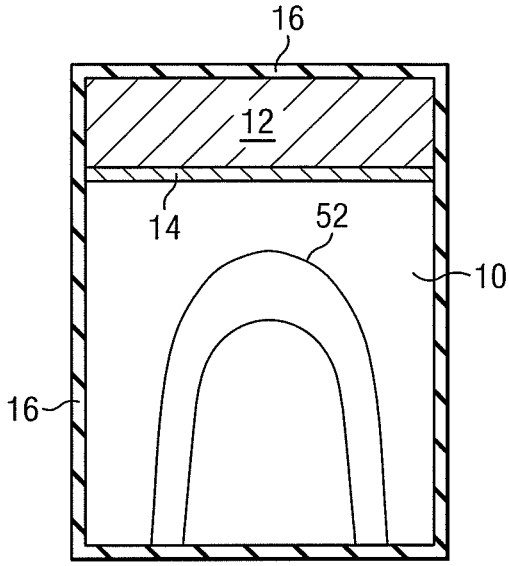
FIG. 1B illustrates a cross-section of a material stack used to form the cutter of FIG. 1A.
Figure 1C:
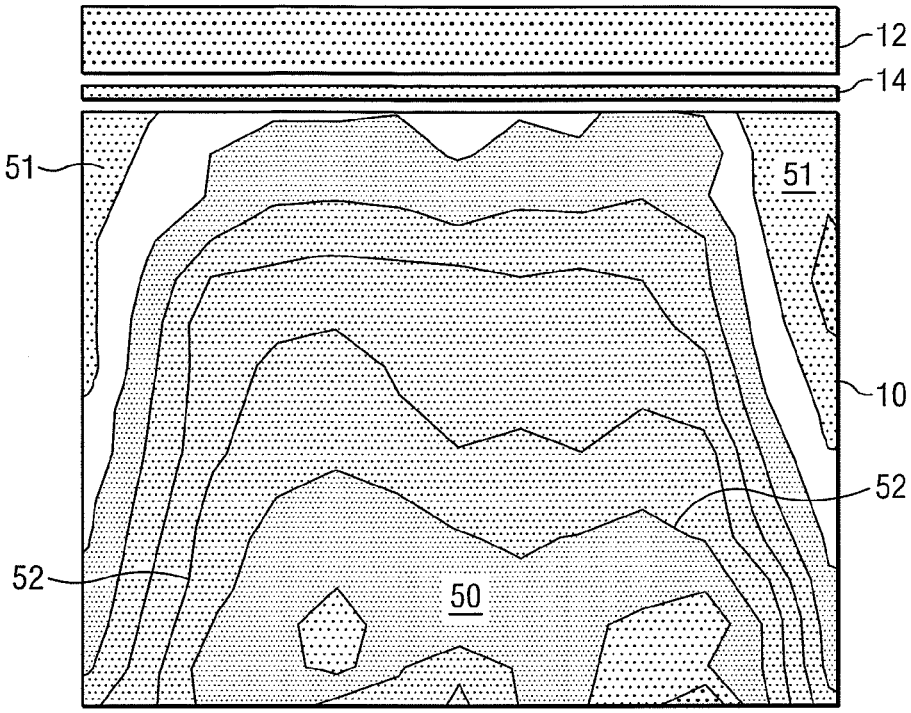
FIG. 1C illustrates individual components of the material stack of FIG. 1B.

Reference is now additionally made to FIG. 1B which illustrates a material stack used to form the cutter of FIG. 1A. FIG. 1C shows the individual components of the stack separated from each other. To manufacture the cutter of FIG. 1A, a thermally stable polycrystalline (TSP) diamond material for the body 12 is created. A selected ultra-hard precursor material, such as diamond, is subjected to a high pressure high temperature (HPHT) treatment process to form a sintered ultra-hard material body. Other materials, such as cubic boron nitride, or diamond and cubic boron nitride mixtures, can be selected as the precursor material. During the HPHT process, a catalyst material, such as cobalt, is used to facilitate diamond-to-diamond bonding wherein the catalyst material moves into interstitial regions as known in the art. The catalyst material may be supplied from a substrate attached to the polycrystalline diamond body or it may be mixed with diamond powder in forming the body. If a catalyst substrate is used, that substrate is subsequently removed, for example by grinding, after completion of the HPHT treatment, leaving only, or substantially only, the polycrystalline diamond material body itself.

The polycrystalline diamond material body is then optionally subjected to acid leaching in order to render a thermally stable polycrystalline (TSP) diamond material body. Any known leaching process may be used. For example, the entire material body may be immersed in a desired acid-leaching agent. Alternatively, only a portion of the material body may be subjected to application with the acid treatment. The choice of an appropriate leaching treatment is left to those skilled in the art. It will also be noted that the body 12 need not be leached for some applications.

The surface of the body 12 which is going to make attachment to the substrate 10, for example, the bottom surface of the body 12, is coated with a thin layer 14 of an imbibition catalyst material such as cobalt (or perhaps another material selected from Group VIII of the Periodic Table of the Elements or any eutectic of these elements). Alternatively, the upper surface of the substrate 10 may instead be coated with a thin layer 14 of the (cobalt) imbibition catalyst material. Still further, both the bottom surface of the body 12 and the upper surface of the substrate 10 may be both coated with the (cobalt) imbibition catalyst material layer 14. In any event, what is important is provision for the existence of a thin (cobalt) imbibition catalyst material layer 14 located (interposed) between the two surfaces of the substrate 10 and diamond table body 12 which are to be joined. The quantity of the imbibition catalyst is defined such that at least 90% will move inside the substrate 10 and body 12 (and preferably 95% and more preferably greater than 98%) during the imbibition and infiltration treatment described herein.

The substrate 10 and diamond table body 12 are then put together for assembly by stacking the diamond table body 12 on top of the substrate 10 as shown in FIG. 1B. The bottom surface of the body 12 and the upper surface of the substrate 10 may be formed to include corresponding flat surfaces at the interface 19 or alternatively complementary interface surfaces at the interface 19 as described in U.S. Patent Application Publication No. 2008/0185189, dated Aug. 7, 2008. The stacking of structures places the imbibition catalyst layer 14 between the diamond table body 12 and the substrate 10.

The surfaces of the thermally stable body 12 which are not going to make attachment to the substrate 10, for example, all surfaces except the bottom surface of the body 12, are coated with a thin protective coating material layer 16 such as graphite, boron nitride, or aluminum oxide. The remaining exposed surfaces of the substrate 10 are also preferably coated with the thin protective coating material layer 16. Those skilled in the art will recognize that the layers 14 and 16 are not necessarily draw to scale in FIG. 1B, but rather are illustrated to show existence and relative placement only.

Figure 3:
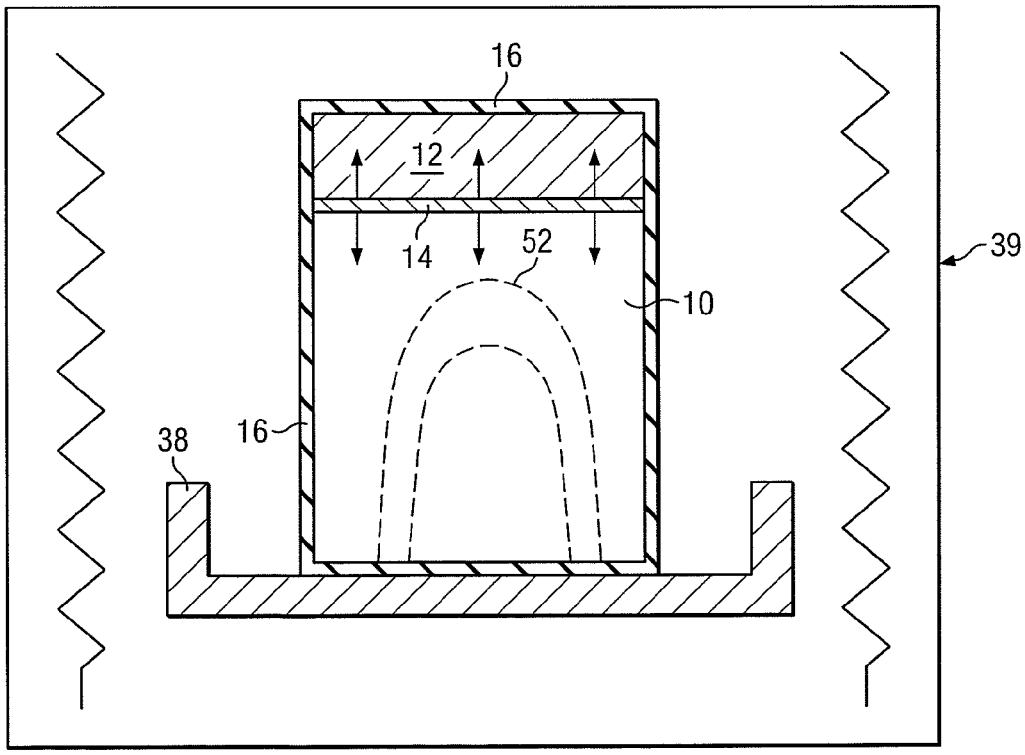
FIG. 3 is a diagram of the production, by imbibition, of the cutter of FIG. 1A.

With reference to FIG. 3, the assembled stack including substrate 10, diamond table 12, imbibition layer 14 and coating layer 16 of FIG. 1B is disposed in a crucible 38 which is chemically inert at the temperatures of the thermal treatment, for example made of aluminum oxide, and which is placed in an oven 39 under a controlled atmosphere, which may be a vacuum oven or an oven under a nitrogen or argon atmosphere. The oven 39 must be capable of reaching a sufficient temperature, so that the imbibition layer 14 material reaches a partially or totally liquid state. The oven must further be capable of high heating and cooling rates so that it is possible to control the time which the assembly will spend above the eutectic temperature above which imbibition and/or infiltration occurs. The oven can be a resistance oven, an induction oven, a microwave oven or a SPS (spark plasma sintering) installation.

The oven 39 subjects the assembly to heat treatment at a high temperature (for example, in range of 1300 to 1400° C.) under a protective atmosphere. The protective atmosphere may be a vacuum or a nitrogen or argon atmosphere. The heat treatment at the high temperature lasts for a desired dwell time. During the heat treatment, and especially at the high temperature held for the desired dwell time, the interposed (cobalt) imbibition catalyst material layer 14 achieves a partial or total material phase state change from the solid into the liquid state. The (cobalt) imbibition catalyst material layer 14 in the liquid state acts as an imbibiting material that penetrates, by migration (see, arrows), into the inside of both the substrate 10 (through imbibition) and diamond table 12 (through infiltration) at and near the upper and bottom surfaces, respectively, which define the interface 19 between the diamond table 12 to the substrate 10. The migration of the (cobalt) imbibition catalyst material atoms from layer 14 serves to bond the diamond table 12 to the substrate 10. The protective coating material 16 prevents atoms from the (cobalt) catalyst material layer 14 from penetrating into surfaces other than the bottom surface of the body 12 and upper surface of the substrate 10. This protection is important so as to preserve the thermal stability, especially on a top surface of the body 12, achieved through the previous controlled cobalt leaching operation. It also affects the kinetics of the migration of the imbibition catalyst material inside both the substrate 10 and body 12 so as to achieve a controlled gradual phase distribution.

After completion of the heat treatment, the distribution (see, dotted line 18) of cobalt concentration is a function of distance from the original interface 19 between the diamond table 12 and the substrate 10 (see, FIG. 1A). Bonding of the diamond table 12 to the substrate 10 is made thanks to the cobalt migration at that interface 19. The resistance of the bonding is a function of the carbide grain size and the initial cobalt content of the substrate and is also as a function of the cobalt coated surface. Thus, the diamond table 12 includes a top surface region 15 from which cobalt has been leached that provides for thermal stability and abrasion resistance, while a bottom surface region 17 of the diamond table 12 at the interface 19 is characterized by a continuous cobalt content distribution 18 which assures the bonding of the diamond table 12 to the substrate 10 and constitutes a resilient phase.

Figure 2:
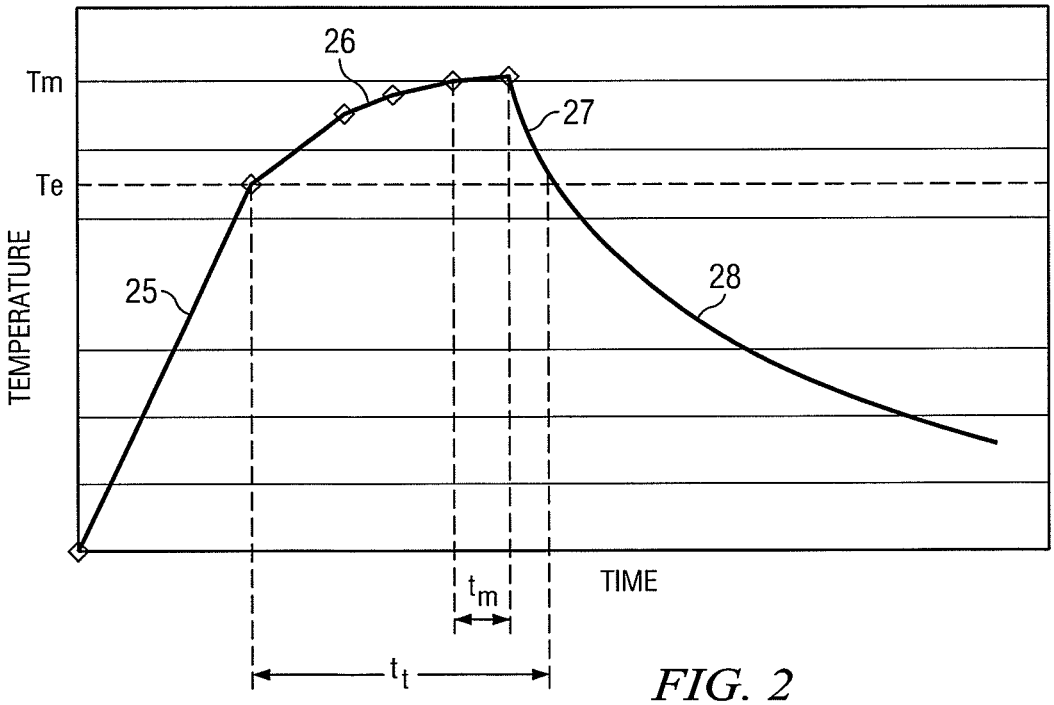
FIG. 2 is a diagram of a thermal imbibition cycle applied to the stack of FIG. 1B in the process of making the cutter of FIG. 1A.

The heat treatment applied to the stack of FIG. 1B is defined by a thermal cycle which comprises, as is shown for example in FIG. 2, a phase 25 of heating the stack to the melting point Te of the eutectic for the (cobalt) imbibition catalyst material layer 14, then a phase 26 in which the temperature is maintained above the temperature Te to a holding temperature Tm at which the stack is maintained for a holding time $t_m$, then a phase 27 in which the stack is cooled very rapidly to a temperature below the temperature Te and, finally, a phase 28 of slower cooling to ambient temperature.

The threshold (dwell) temperature need not be significantly different from the temperature Te, but must be sufficiently different to produce enough liquid from and permit wetting and migration of the (cobalt) catalyst material layer 14. That temperature difference is, for example, not more than 100° C. and preferably less than 50° C.

The total time $t_t$ above the minimum imbibition temperature Te, in general less than 15 minutes, as well as the holding temperature Tm and the holding time $t_m$, are chosen to ensure suitable distribution of the (cobalt) catalyst material layer 14 atoms on either side of the interface. One skilled in the art can select the thermal cycle parameters.

Initial cooling between the holding temperature Tm and the minimum imbibition temperature Te is carried out relatively rapidly so as to avoid uncontrolled migration of the (cobalt) catalyst imbibition material atoms at or about the interface. To that end, it is desirable for the rate of rapid cooling to be greater than 40° C./min., preferably greater than 50° C./min. and more preferably greater than 60° C./min. However, in order to avoid producing excessive stresses in the stack, it is preferable for the cooling rate to remain below 100° C./min. Below the eutectic temperature Te, because further migration of the imbibiting material atoms is prevented, cooling is carried out at a substantially slower rate in order to avoid generating excessive residual stresses inside the stack which would result in flaws or defects in the cutter.

The substrate 10 used in a cutter (such as for a drilling tool, or more generally for a cutting tool) is an element comprising a block of generally parallelepipedal or cylindrical shape which is obtained by powder metallurgy and constituted by a material whose structure comprises on the one hand hard particles such as metal carbides, and in particular tungsten carbides, and on the other hand a binder phase constituted by a metal or metal alloy which, on contact with the carbides, can form, at temperature, a eutectic having a melting point lower than both the melting point of the carbides and the melting point of the metal or metal alloy. The metal or metal alloy is, for example, cobalt, but may also be iron, or nickel, or a mixture of those metals. In addition, the binder phase can comprise alloying metals, the sum of the contents of which can reach 15% by weight but generally does not exceed 1% by weight. The alloying metals can be copper, for improving the electrical conductivity, or silicon, the effect of which is to lower the surface tension relative to the system constituted by the carbide and by the binder phase, or can be carbide-forming elements which can form mixed carbides or carbides of the $M_xC_y$ type other than tungsten carbide. These different elements are especially manganese, chromium, molybdenum, tungsten, vanadium, niobium, tantalum, titanium, zirconium and hafnium.

In addition to those principal elements, the composition of the binder phase can comprise alloying elements which are conventionally found in such materials and which modify the shape and/or inhibit the growth of the hard particles. The person skilled in the art knows of such elements. Finally, the chemical composition of those materials comprises unavoidable impurities resulting from the preparation processes. The person skilled in the art knows of such impurities.

For some applications, diamond particles are added in order to increase the wear resistance of the cutters. Such diamond particles are added to the powder mixture which is used to produce the block by sintering. In general, after sintering, the block is dense and constituted by hard particles dispersed in a binder phase.

In the case of the WC-Co system, the composition of the eutectic which forms at temperature has a cobalt content of about 65% by weight. Of course, the use properties of the block that are thus obtained depend especially on the relative proportions of carbide(s) and of metal or metal alloy. In the case of drilling materials, the content of binder phase is generally far lower than that of the eutectic and even substantially less than 35% by weight. In fact, the lower the content of binder phase, the higher the hardness, and hence the wear resistance, of the material. However, the lower the content of binder phase, the lower the toughness of the cermet. These properties of cermets are known to the person skilled in the art.

Furthermore, the properties of the cermet also depend on the size and shape of the carbide grains.

In order to improve the properties of the substrate block, a method is presented for enriching part of the substrate block with binder phase and optionally modifying its composition, by imbibition, starting from a dense sintered cermet.

The phenomenon of imbibition is possible in biphase systems (hard particles—binder phase) that fulfill certain conditions. Accordingly, the binder phase, at the imbibition temperature ($T \geq Te$), must wet the hard particles, those same hard particles must be partially soluble in the binder phase at the imbibition temperature, and the system must exhibit Ostwald maturation with modification or not of the shape of the hard particles without necessarily an increase in the size of the particles by the dissolution-reprecipitation phenomenon.

In order to carry out the imbibition it is necessary to bring a cermet having a content of binder phase below a critical content (35% by weight in the case of the WC-Co system) in contact with an imbibiting material of a suitable composition and to bring the whole to such a temperature that the imbibiting material and the binder phase are liquid or at least partially liquid. When those conditions are met, transfer of binder phase to the inside the cermet takes place, and the cermet is therefore enriched with binder phase. In general, the composition of the imbibiting material is preferably identical with or similar to that of the eutectic of the cermet in question. In that case, the imbibition increases the content of binder phase in the cermet without modifying the chemical composition of the material. This phenomenon can continue until the cermet is saturated with binder phase. For a cermet of the tungsten carbide/cobalt type with an imbibiting material of the same nature, saturation is obtained for a cobalt content of about 35% by weight in the cermet.

The imbibiting material can have a different composition to that of the binder phase of the cermet. In that case, not only is the cermet enriched with binder phase, but the chemical composition thereof, and optionally of the carbide phase, is also modified.

The imbibition phenomenon is activated thermally and its kinetics are therefore linked to not only the temperature but also to the initial content of binder phase in the cermet, as well as to the size and shape of the hard particles.

Imbibition is generally used to enrich cermet blocks with binder phase by immersing one of their ends in a liquid having the composition of the eutectic of the cermet in question. A disadvantage of that method is that the imbibiting material migrates into the cermet not only through the contact zone(s) but also through the faces that are adjacent to the contact zone(s), making the shape of the gradient difficult to control.

Therefore, in order to obtain the desired result, which is the inverse of the result conventionally obtained with immersion, the following process and procedure is provided for using imbibition to form a functionally graded block suitable for use as a substrate 10.

Figure 4:
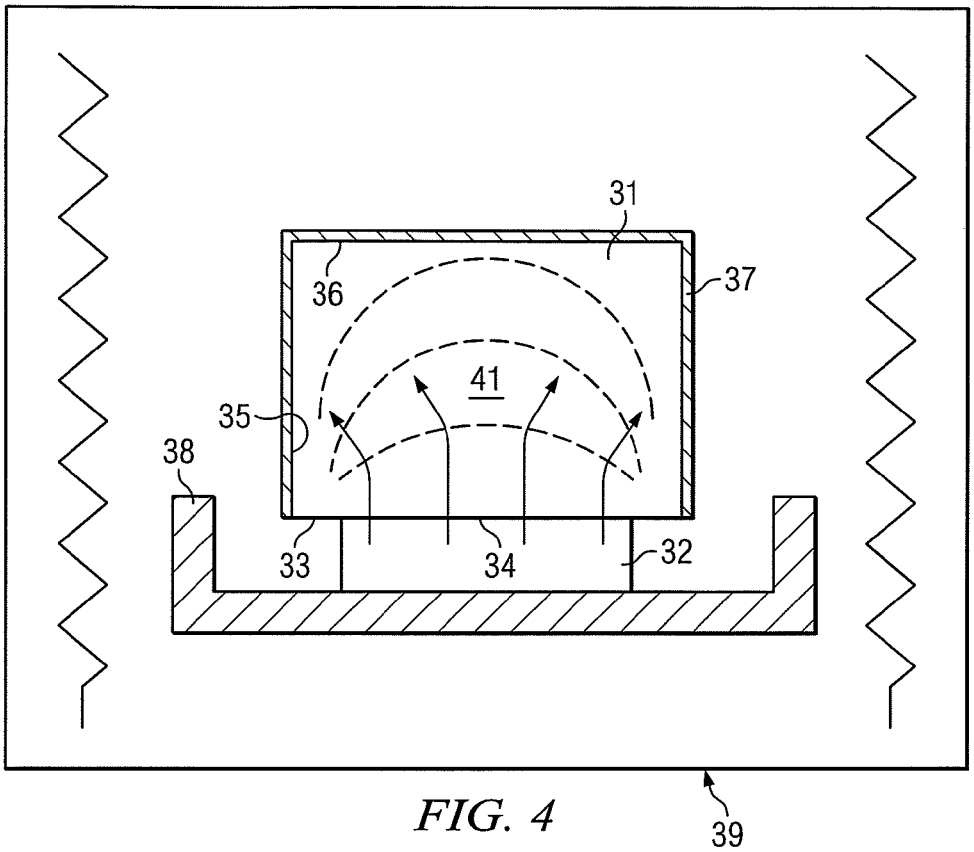
FIG. 4 is a diagram of the production, by imbibition, of a dense cermet block having a hard outside surface and a tough core.

FIG. 4 illustrates a block 31 to be treated, which is made of a material constituted by hard particles embedded in a binder phase. The block 31 is in contact with a pellet 32 constituted by an imbibiting material which, from a certain temperature, is capable of migrating to the inside of the block 31 by imbibition. The block 31 is generally cylindrical or parallelepipedal in shape and comprises a lower face 33, one or more side faces 35 and an upper face 36. The pellet 32 of imbibiting material is in contact with the lower face 33 of the block 31. The contact area 34 between the pellet 32 of imbibiting material and the lower face 33 of the block 31, also called the imbibition area, has a surface area substantially smaller than the surface area of the lower face 33 of the block 31. The shape of the resulting gradient is determined especially by the positioning and the extent of the imbibition area relative to the lower face 33 of the cermet.

The lateral face or faces 35 and the upper face 36 of the block 31 are covered with a layer 37 of a coating material. The coating material, which is boron nitride, for example, is intended on the one hand to prevent the transfer of imbibiting material through the protective layer and on the other hand to modify the kinetics of migration of the binder phase into the block and the shape of the gradient properties.

The assembly constituted by the block 31, with its coating layer 37, and by the pellet 32 of imbibiting material is disposed in a crucible 38 which is chemically inert at the temperatures of the thermal treatment, for example made of aluminum oxide, and which is placed in an oven 39 under a controlled atmosphere, which may be a vacuum oven or an oven under a nitrogen or argon atmosphere. The oven must be capable of reaching a sufficient temperature, so that the imbibiting material and the binder phase of the block are partially or totally in the liquid state, for example 1350° C. (or even 1320° C.) in the case of a block of WC-Co. The oven must further be capable of high heating and cooling rates so that it is possible to control the time which the assembly will spend above the eutectic temperature of the treated system, which is the temperature above which imbibition occurs and which, for cermets of the WO-Co type, is of the order to 1300° C. The oven can be a resistance oven, an induction oven, a microwave oven or a SPS (spark plasma sintering) installation.

The block is then subjected to a thermal cycle, which first comprises heating to a temperature higher than or equal to the temperature at which at least the contact zone 4 between the pellet 32 of imbibiting material and the lower surface 33 of the block 31 passes into the liquid state. Heating is carried out in such a manner that the temperature inside the block is higher than the melting point Te of the eutectic of the block.

Preferably, the natural temperature gradient of the oven will be used, so that heating is carried out in such a manner that the temperature inside the pellet 32 remains below the melting point of the imbibiting material.

By proceeding in that manner, the imbibiting material penetrates, by migration (see, arrows), into the inside of the block in the region of the contact zone between the pellet of imbibiting material and the lower surface of the block. On the other hand, it does not migrate through the outer side walls 35 or through the upper wall 36 of the block. Accordingly, enrichment of the block with imbibiting material occurs substantially in an inner zone 41 which opens at the lower wall 33 and extends towards the inside of the block.

Figure 5:
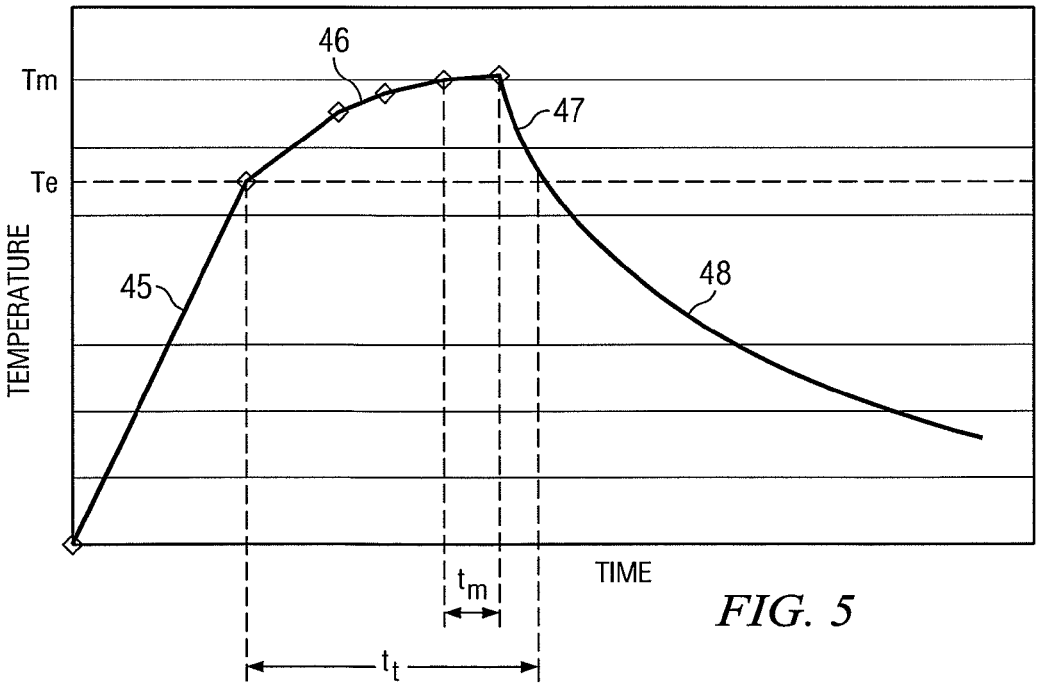
FIG. 5 is a diagram of a thermal imbibition cycle of a dense cermet block having a hard outside surface and a tough core.

More precisely, the thermal treatment comprises, as is shown in FIG. 5, a phase 45 of heating to the melting point Te of the eutectic, then a phase 46 in which the temperature is maintained above the temperature Te to a holding temperature Tm at which the block is maintained for a holding time $t_m$, then a phase 47 in which the block is cooled very rapidly to a temperature below the temperature Te and, finally, a phase 48 of slower cooling to ambient temperature.

During the heating phase, below the temperature Te, the imbibiting material solidifies and undergoes shrinkage. Above the temperature Te, a eutectic liquid forms at the contact surface.

The threshold (dwell) temperature must not be too different from the temperature Te, but must be sufficiently different to produce enough liquid and permit wetting and migration of a liquid in chemical equilibrium with the cermet to be imbibited. That temperature difference is, for example, not more than 100° C. and preferably less than 50° C.

The total time $t_t$ above the minimum imbibition temperature Te, in general less than 15 minutes, as well as the holding temperature Tm and the holding time $t_m$, are chosen to ensure suitable distribution of the imbibiting material inside the block. The person skilled in the art knows how to choose those parameters.

Cooling between the threshold temperature and the eutectic imbibition temperature is carried out rapidly so as to avoid uncontrolled migration of the imbibiting material.

To that end, it is desirable for the rate of rapid cooling to be greater than 40° C./min., preferably greater than 50° C./min. and more preferably greater than 60° C./min. However, in order to avoid producing excessive stresses in the block, it is preferable for the cooling rate to remain below 100° C./min.

Below the eutectic temperature Te, because migration of the imbibiting material is prevented, cooling is carried out at a substantially slower rate in order to avoid generating excessive residual stresses inside the block.

Figure 6:
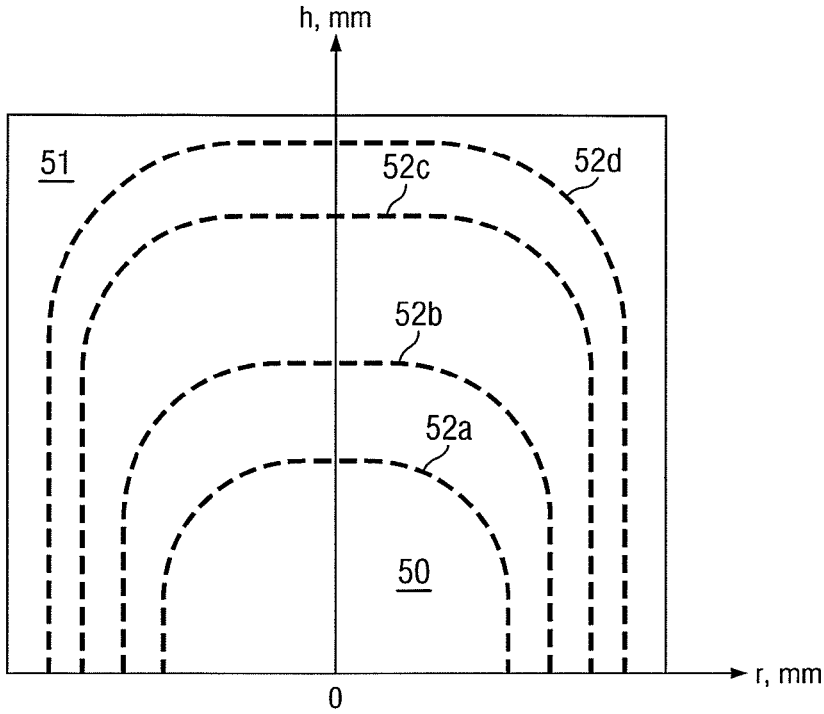
FIG. 6 is a diagram in section of a dense cermet, the core of which has been made tougher by imbibition.

By proceeding in that manner, functionally graded blocks (for example useful as substrates 10 in the stack of FIG. 1B) such as that shown in section in FIGS. 1C and 6 are obtained, comprising a core 50 having a high content of binder phase and an outside zone 51 having a low content of binder phase. Because of its low content of binder phase, the outside zone 51 has very high hardness, and therefore very high wear resistance, but low toughness. By contrast, because of its high content of binder phase, the inside zone core 50 has very good toughness.

Figure 7:
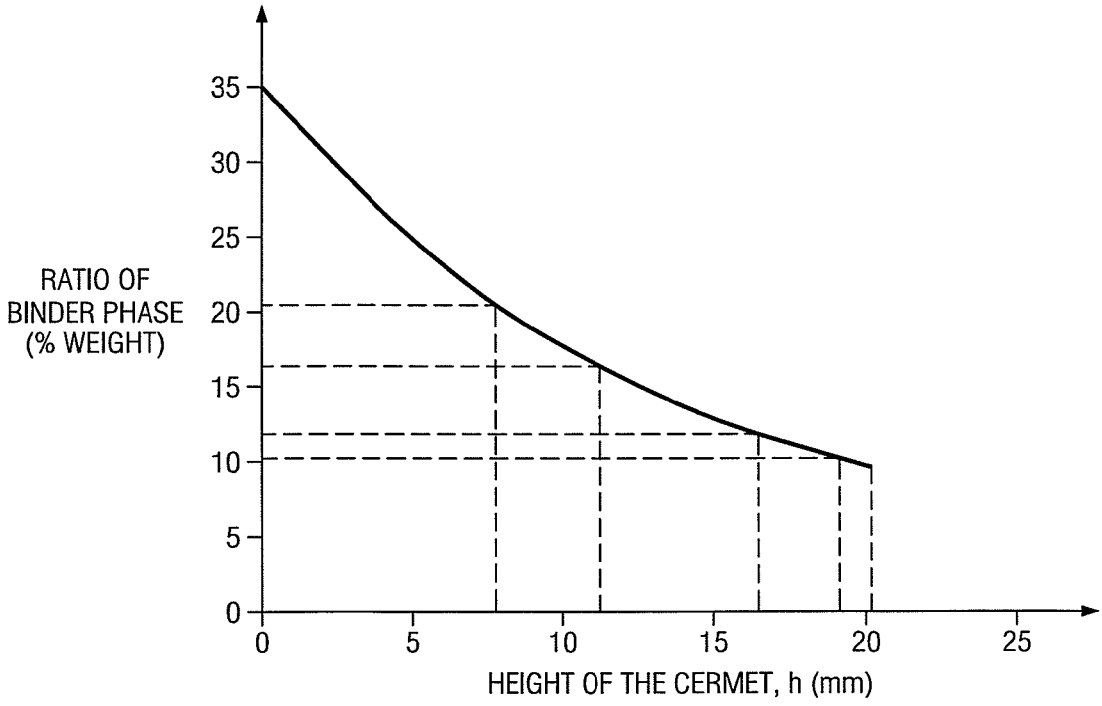
FIG. 7 is a diagram illustrating a comparison between height of cermet and ratio of binder phase.

Owing to the imbibiting process which has just been described and which corresponds to a gradual enrichment of the cermet with binder phase, the change in the content of binder phase takes place continuously and diminishes from the core 50 towards the active faces of the block. This is shown diagrammatically by dotted lines of equal binder phase content 52*a*, 52*b*, 52*c*, 52*d* in FIG. 6 and in FIG. 7 by a profile of repartition of the binder phase along the height from the lower face to the upper face of the dense cermet. See, also, FIGS. 1C and 9C which illustrate with lines 52 in a less-idealized manner the gradient changes in binder phase content. The lines 52 with respect to binder phase content are also schematically shown in FIGS. 1A and 1B.

When the cermet block is of the tungsten carbide/cobalt type, it must have a cobalt content less than 35% by weight. Above that content, the imbibiting process stops. In order to enrich such a block with its own binder, the block is brought into contact with an imbibiting material constituted by a mixture of tungsten carbide/cobalt in which the cobalt content can vary from 35 to 65% by weight. Preferably, for the WC-Co system, the mixture has the eutectic composition corresponding to 65% by weight cobalt. The tungsten carbide/cobalt mixture is homogenized, preferably in a Turbula, for several hours. The mixture is then compacted, for example at low temperature in a single-action mould, or is mixed with an aqueous cement. When the imbibiting material is compacted at low temperature, it is in the form of a pellet which is brought into contact with the coated block that is to be treated. When the imbibiting material is constituted by a powder mixed with an aqueous cement, it can be deposited on the coated block by means of a brush in a delimited zone which can be of any shape. It can also be deposited by techniques of the plasma projection or laser projection type. The technique of deposition by means of a brush or by projection has the advantage of allowing the imbibiting material to be deposited in any zone of a block, the shape of which can be more complex than that of a parallelepiped or a cylinder.

It will be noted that, for each coated block to be treated, the size and shape of the imbibition area must be adapted to the shape of the gradient that is to be generated inside the block. The person skilled in the art knows how to make such adaptations.

In the embodiment which has just been described, it is provided to cover the outside surface of the block to be treated with a coating material 37. However, provided that the imbibition area is limited and does not extend at the imbibition temperature, it is not essential to cover the outside surface of the block with a coating material. The imbibition area can, in fact, be limited to a single face, which results in migration that occurs solely in an inside axial portion of the block.

Besides, it has been found that the presence of the coating layer on the outside surface of the block had a significant effect on the migration of the imbibiting material inside the block. In particular, it has been found that the coating layer makes it possible to obtain a binder phase gradient, and consequently a hardness gradient, which is much more considerable than that which can be obtained in the absence of the coating material.

That effect is illustrated by the two examples which follow, which both relate to the treatment of a dense block of tungsten carbide/cobalt in which the cobalt content prior to treatment is 13% by weight, the imbibiting material being constituted by a pellet of tungsten carbide/cobalt having a eutectic composition, that is to say containing about 65% by weight cobalt. In both cases, the assembly is disposed in an aluminum oxide crucible inside a resistance oven and is heated at a temperature of 1350° C. (sample temperature) for 3 minutes.

In the first example, the outside walls of the block which were not to come into contact with the imbibiting material were covered with a coating material constituted by boron nitride. After treatment, the hardness in the vicinity of the outside surface of the block was of the order of 1370 HV, while the minimum hardness inside the core of the block was only 890 HV, namely a difference in hardness of the order of 480 HV, it being possible for the variation in hardness to be obtained over distances of the order of 5 mm.

In the second example, the outside walls of the block were not covered with the coating layer. The maximum hardness observed was 1200 HV at the outside surface of the block, and the minimum hardness at the core of the block was 1010 HV, which corresponds to a difference of only 190 HV.

There can be different explanations for the difference between these two results. It is possible especially to think that the coating material increases the interfacial energy between the binder phase and the carbide phase and therefore has an effect on the migration of the binder phase to the inside of the block.

The process which has just been described, and which permits the production of blocks which are to constitute tool bits, has the advantage of allowing blocks to be obtained whose outside portion is hard and whose inside portion is tough.

As discussed above, the block 31 can be used as a substrate 10 in forming a cutter. Thus, after imbibition of the block is completed in the manner described in connection with FIGS. 4-7, a diamond table body 12 is joined to the upper face 36 of the block (see, FIGS. 1A and 1B) through an imbibition treatment using an interposed (cobalt) imbibition material layer 14 (FIG. 3). In this case, the upper face of the block would be the face 36 opposite the contact area 34. Alternatively, as described below in more detail, the diamond table body 12 is joined to the face 33 of the block 31 through an imbibition treatment that may or may not use an interposed (cobalt) imbibition material layer 14.

Figure 8:
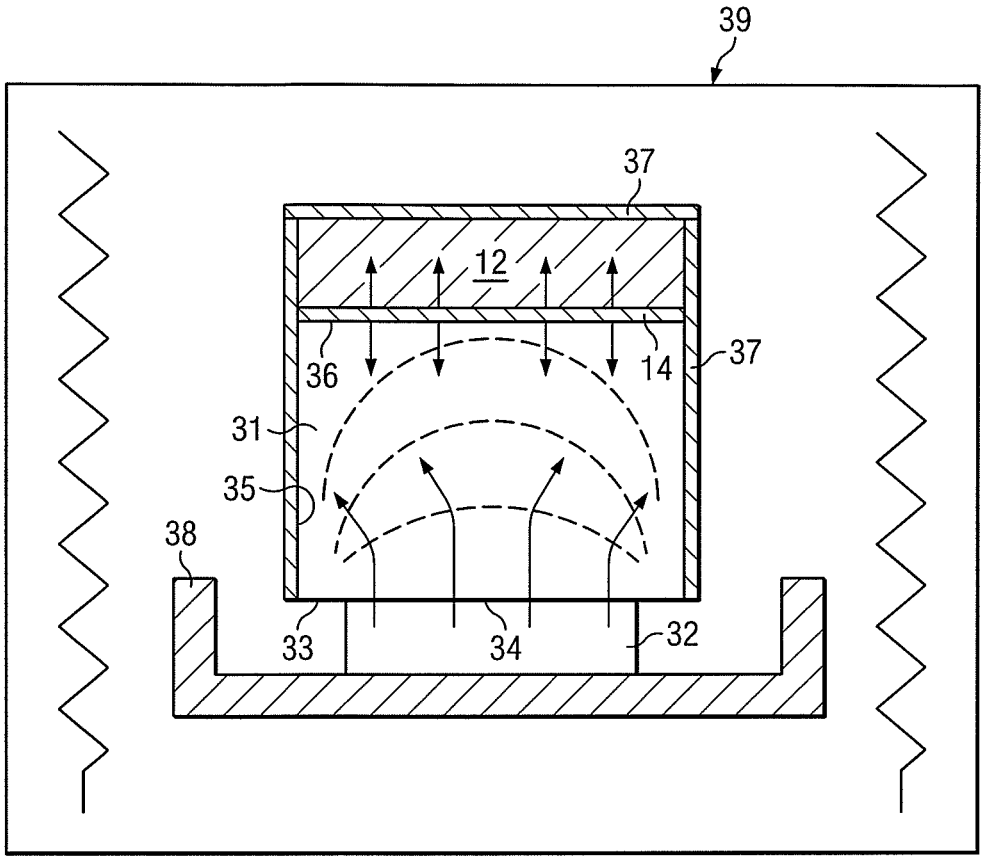
FIG. 8 is a diagram of the production, by imbibition, of a diamond table attached to a dense cermet block having a hard outside surface and a tough core.

In another embodiment, the process for imbibition of the block 31 and attachment of the diamond table body 12 can be combined together in a single heat treatment cycle. Reference is now made to FIG. 8 which is a diagram of the production, by imbibition, of a diamond table attached to a dense cermet block having a hard outside surface and a tough core. A block 31 is made of a material constituted by hard particles embedded in a binder phase. The block 31 is positioned in contact with a pellet 32 constituted by an imbibiting material which, from a certain temperature, is capable of migrating to the inside of the block 31 by imbibition. The block 31 is generally cylindrical or parallelepipedal in shape and comprises a lower face 33, one or more side faces 35 and an upper face 36. The pellet 32 of imbibiting material is in contact with the lower face 33 of the block 31. The contact area 34 between the pellet 32 of imbibiting material and the block 31, also called the imbibition area, has a surface area substantially smaller than the surface area of the lower face 33 of the block 31. The shape of the gradient is determined especially by the positioning and the extent of the imbibition area relative to the lower face 33 of the cermet.

A thermally stable polycrystalline (TSP) diamond material body 12 is placed on the upper face 36 of the block 31. The bottom surface of the body 12 and the upper surface 36 of the substrate block 31 may be formed to include corresponding flat surfaces at the interface or alternatively complementary interface surfaces at the interface as described in U.S. Patent Application Publication No. 2008/0185189, dated Aug. 7, 2008. The surface of the body 12 which is going to make attachment to the substrate block 31, for example, the bottom surface of the body 12, is coated with a thin layer 14 of an imbibition catalyst material such as cobalt (or perhaps another material selected from Group VIII of the Periodic Table of the Elements or any eutectic of these elements). Alternatively, the upper surface 36 of the substrate block 31 may instead be coated with a thin layer 14 of the (cobalt) imbibition catalyst material. Still further, both the bottom surface of the body 12 and the upper surface of the substrate block 31 may be both coated with the (cobalt) catalyst material layer 14. In any event, what is important is provision for the existence of a thin (cobalt) catalyst material layer 14 located (interposed) between the two surfaces of the substrate block 31 and diamond table body 12 which are to be joined.

The lateral face or faces 35 of the block 31, as well as the exposed surfaces of the diamond table body 12, are covered with a layer 37 of a coating material. The coating material, which is boron nitride, for example, is intended on the one hand to prevent the transfer of imbibiting material through the protective layer and on the other hand to modify the kinetics of migration of the binder phase into the block 31 and the shape of the gradient properties.

The assembly constituted by the block 31, table 12, coating layer 37, imbibition layer 14 and pellet 32 of imbibiting material is disposed in a crucible 38 which is chemically inert at the temperatures of the thermal treatment, for example made of aluminum oxide, and which is placed in an oven 39 under a controlled atmosphere, which may be a vacuum oven or an oven under a nitrogen or argon atmosphere. The block is then subjected to a thermal cycle such as that shown in FIGS. 2 and 5, with arrows indicating migration by imbibition and/or infiltration. The result is a cutter of the configuration shown in FIG. 1A.

As discussed above, the substrate block 31 which has been enriched by imbibition can be used as the substrate 10 in the implementation illustrated in FIGS. 1A and 1B. Attachment of the diamond table body 12 uses an imbibition process with a layer 14. As an alternative, the substrate block 31 can be turned upside down and attachment of the diamond table body 12 is made to the lower face 33 of the block 31 at the contact area 34. This implementation is illustrated in FIGS. 9A and 9B.

Figure 9A:
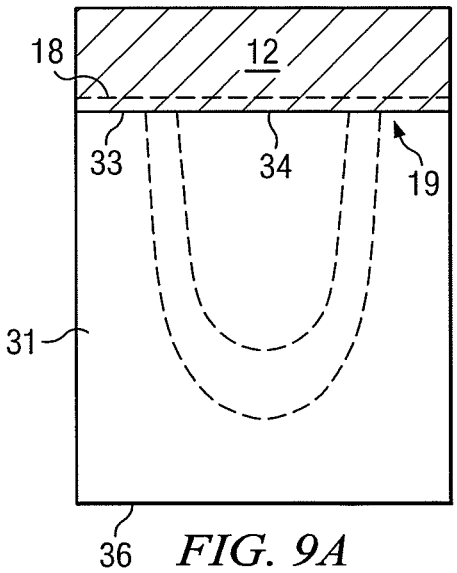
FIG. 9A illustrates a cross-section of a cutter for a drilling tool constituted by a substrate to which a diamond tip has been secured through an imbibition process.
Figure 9B:
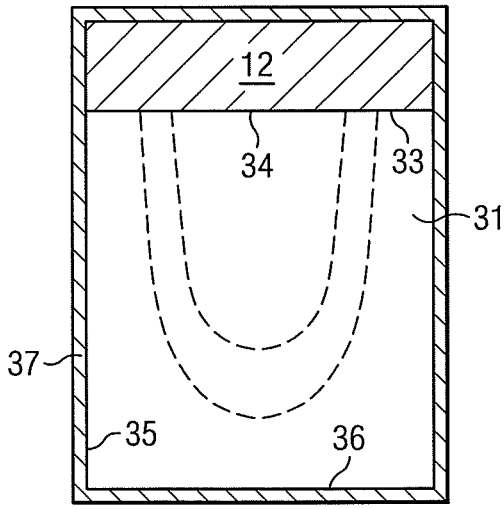
FIG. 9B illustrates a cross-section of a material stack used to form the cutter of FIG. 9A.
Figure 9C:
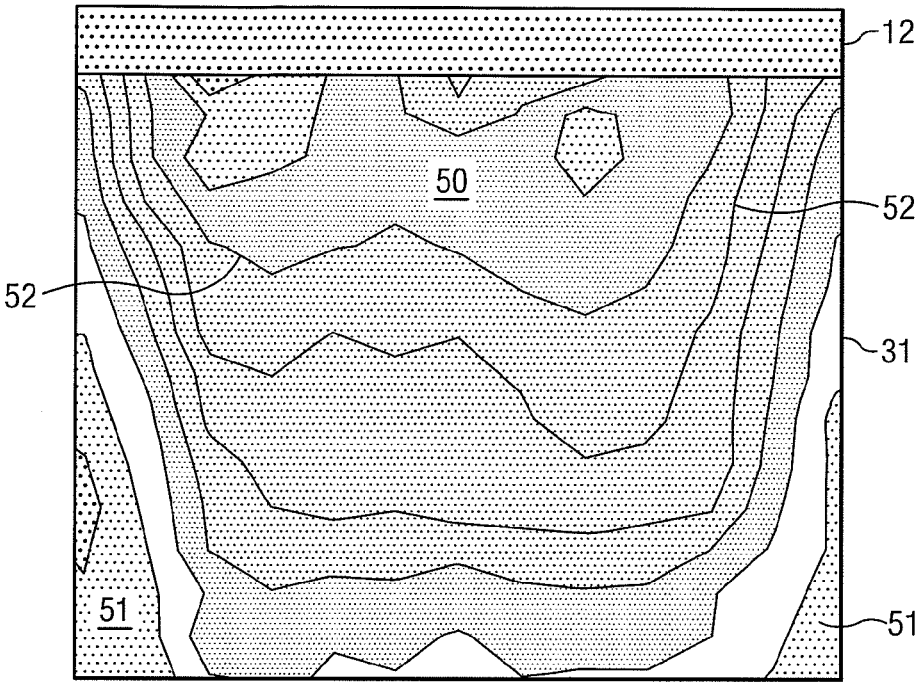
FIG. 9C illustrates the material stack and shows a less-idealized representation of the gradient change in binder phase content.

FIG. 9A illustrates a cross-section of a cutter for a drilling tool constituted by a substrate block 31 to which a diamond table body 12 has been secured through an imbibition process. A polycrystalline diamond body (also referred to in the art as a diamond table or diamond tip) 12 is mounted to a lower face 33 of the block 31. FIG. 9B illustrates the material stack used to form the cutter of FIG. 9A. Because imbibition has already occurred at the lower face 33 of the block 31 through the contact area 34 (see, FIGS. 4-7), imbibition catalyst material (such as cobalt) useful for attachment of the body 12 is already present at and near the lower face 33. Thus, there is no need to include an imbibition layer 14 as in FIG. 1B (although such a layer could be provided if desired). The bottom surface of the body 12 and the lower surface 34 of the substrate block 31 may be formed to include corresponding flat surfaces at the interface 19 or alternatively complementary interface surfaces at the interface 19 as described in U.S. Patent Application Publication No. 2008/0185189, dated Aug. 7, 2008.

The surfaces of the thermally stable body 12 which are not going to make attachment to the substrate block 31 are coated with a thin protective coating material layer 37 such as graphite, boron nitride, or aluminum oxide. The exposed surfaces of the substrate block 31 are also preferably coated with the thin protective coating material layer 37. Those skilled in the art will recognize that the layer 37 is not necessarily drawn to scale in FIG. 9B, but rather are illustrated to show existence and relative placement only.

Figure 10:
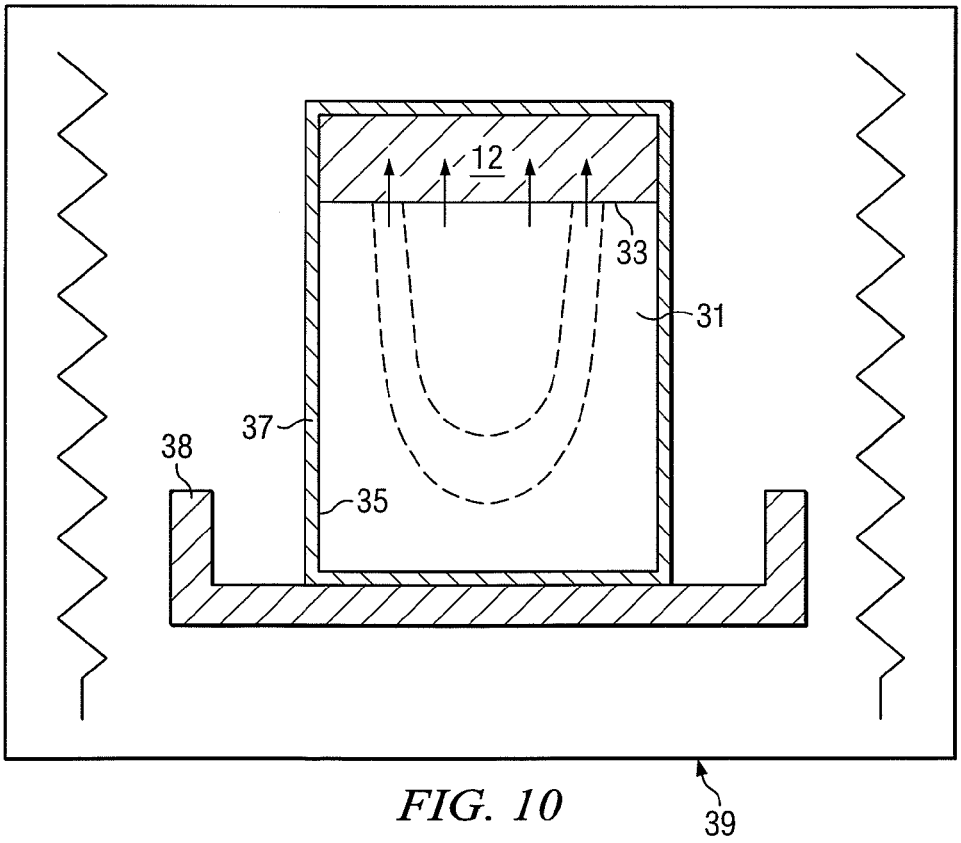
FIG. 10 is a diagram of the production, by imbibition, of the cutter of FIG. 9A.

With reference to FIG. 10, the assembly constituted by the block 31, table 12 and coating layer 37 is disposed in a crucible 38 which is chemically inert at the temperatures of the thermal treatment, for example made of aluminum oxide, and which is placed in an oven 39 under a controlled atmosphere, which may be a vacuum oven or an oven under a nitrogen or argon atmosphere. The block is then subjected to a thermal cycle such as that shown in FIGS. 2 and 5 with the arrows indicating migration direction. The result is a cutter of the configuration shown in FIG. 9A.

The processes described herein permit the production of cutters for the heads of drilling tools such as tricone bits, PDC bits or TSP bits, impregnated bits for oil and gas drilling, or bits for rock-cutting or rock-fragmenting tools or for the drilling of blast holes, in the field of mining, civil engineering, or tools for working materials.

The cutters produced in accordance with the processes described herein can be fitted to any type of tool for oil and gas drilling or mine drilling or in the civil engineering field, especially to any ground- or subsoil-excavating machine. Those applications are in particular picks used on mining machines of the "localized excavation" type or of the "continuous miner" type or of the "raise borer" type or machines for tunneling into soft rock. Such applications can also be wheels used especially on full-section machines, such as tunneling machines or road-boring machines, or rotary drilling bits or roto-percussive drilling bits.

The process can also be used for producing elements for metalworking tools, for which it is desirable to obtain a very hard active surface on a tougher body.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A process, comprising:

forming an enriched block of dense material by:

bringing a first contact surface of a block of dense material into contact with a second contact surface of an imbibition block, the imbibition block formed of an imbibiting material, wherein an area of the first contact surface of the dense material block is larger than an area of the second contact surface of the imbibition block; and subjecting the dense material block and imbibition block to a first thermal cycle, constituted by heating, temperature maintenance and cooling, which brings at least some of the imbibiting material into the liquid state for migration through an imbibition area where the second contact surface meets the first contact surface for local and gradual enrichment of the dense material block with the imbibiting material defining an imbibiting material gradient extending in the enriched dense material block in all directions from a core region corresponding to the area of the second contact surface;

stacking a thermally stable diamond table body on the enriched block of dense material at an interface which includes a bottom surface of the thermally stable diamond table body in contact with the first contact surface of the enriched dense material block; and subjecting the stack of thermally stable diamond table body and enriched dense material block to a second thermal cycle, constituted by heating, temperature maintenance and cooling, which brings at least some of the imbibiting material within the enriched dense material block into the liquid state for migration from the enriched dense material block into the thermally stable diamond table body through the interface so as to join the thermally stable diamond table body to the enriched dense material block.

2. The process according to claim 1, further comprising:

coating surfaces of the thermally stable diamond table body other than the bottom surface with a coating material; and coating surfaces of the enriched block of dense material other than the first contact surface;

wherein the coating material prevents migration of the imbibiting material through the surfaces to which the coating material is applied.

3. The process according to claim 2, wherein the imbibiting material has properties which support locally enriching the block of dense material with binder phase by imbibition.

4. The process according to claim 3, wherein the coating material modifies kinetics of migration of the binder phase so as to create a gradual binder phase distribution.

5. The process according to claim 2, wherein the coating layer comprises a material selected from the group consisting of a boron nitride, a graphite or an aluminum oxide.

6. The process according to claim 1, material block is a cermet of the WC-Co or WC-(Co and/or Ni and/or Fe) type, and wherein the imbibiting material is of the WC-M type, M being constituted by one or more metals selected from the group consisting of Co, Ni and Fe.

7. The process according to claim 1, wherein the dense material block is a cermet block of the WC-binder type, wherein the binder material is selected from the group consisting of Co, Ni and Fe, and wherein the imbibiting material is made of the same binder material.

8. The process according to claim 1, wherein the dense material block is a tungsten carbide block, wherein the imbibiting material is made from cobalt, and wherein the thermally stable diamond table body has been subjected to a cobalt leaching process which removes interstitial cobalt atoms, and wherein said second thermal cycle causes imbibiting material to migrate from the enriched dense material block into the thermally stable diamond table body defining another imbibiting material gradient extending in the thermally stable diamond table body from the interface.

9. The process according to claim 1, wherein the dense material block is a cermet, and the imbibiting material is a material which bonds the thermally stable diamond table body to the cermet by migration of imbibiting material atoms into the thermally stable diamond table body defining another imbibiting material gradient extending in the thermally stable diamond table body from the interface.

10. A process, comprising:

forming a stack comprising a diamond table with a lower surface in direct contact at an interface with an upper surface of a dense material substrate which includes imbibiting material within the dense material substrate; and subjecting the stack to a thermal cycle within a vacuum environment including heating, temperature maintenance and cooling in order to cause migration of atoms of the imbibiting material from the dense material substrate into the diamond table through the interface so as to join the diamond table to the dense material substrate.

11. The process according to claim 10, wherein the diamond table is of a thermally stable polycrystalline diamond type, wherein a catalyst material has been leached from the diamond table, and wherein the imbibiting material is formed from that same catalyst material, and wherein said thermal cycle causes imbibiting material to migrate from the enriched dense material block into the diamond table defining an imbibiting material gradient extending in the diamond table from the interface.

12. The process according to claim 10 further comprising locally and gradually enriching the dense material substrate through the upper surface with binder phase of the imbibiting material by imbibition prior to forming the stack.

13. The process according to claim 12 wherein enriching comprises:

placing a surface of the imbibiting material into contact with the upper surface of the dense material substrate, wherein an area of the imbibiting material surface is smaller than an area of the upper surface of the dense material substrate; and subjecting the dense material substrate and imbibiting material to a thermal cycle including heating, temperature maintenance and cooling which brings at least some of the imbibiting material into the liquid state for migration through an imbibition area where the surface of the imbibiting material contacts the upper surface of the dense material substrate for local and gradual enrichment of the dense material substrate defining an imbibiting material gradient extending in the enriched dense material substrate in all directions from a core region corresponding to the area of the imbibiting material surface.

14. The process according to claim 10, wherein the dense material substrate further includes a lower surface opposite the upper surface, further comprising locally and gradually enriching the dense material substrate through the lower surface with binder phase by imbibition.

15. The process according to claim 14 wherein enriching comprises:

placing a surface of the imbibiting material into contact with the lower surface of the dense material substrate, wherein an area of the imbibiting material surface is smaller than an area of the lower surface of the dense material substrate; and subjecting the dense material substrate and imbibiting material to a thermal cycle including heating, temperature maintenance and cooling which brings at least some of the imbibiting material into the liquid state for migration through an imbibition area where the surface of the imbibiting material contacts the lower surface of the dense material substrate for local and gradual enrichment of the dense material substrate defining an imbibiting material gradient extending in the enriched dense material substrate in all directions from a core region corresponding to the area of the imbibiting material surface.

16. The process according to claim 10 wherein the dense material substrate includes an enriched concentration of imbibiting material atoms at and near the upper surface of the dense material substrate, the thermal cycle causing imbibiting material atoms to migrate from the upper surface of the enriched dense material substrate into the diamond table defining an imbibiting material gradient extending in the diamond table from the interface.

17. The process according to claim 10, further comprising:

coating surfaces of the diamond table other than at the interface with a coating material;

wherein the coating material prevents migration of the imbibiting material atoms into the diamond table through surfaces to which the coating material is applied.

18. A process, comprising:

forming an enriched block of dense material by:

bringing an imbibition area on a surface of a block of dense material into contact with an imbibition block, the imbibition block formed of an imbibiting material; and subjecting the dense material block and imbibition block to a first thermal cycle causing at least some of the imbibiting material to migrate from the imbibition block through the imbibition area surface for enrichment of the block of dense material;

stacking a thermally stable diamond table body on the enriched block of dense material at an interface which includes a bottom surface of the thermally stable diamond table body and the imbibition area surface of the enriched block of dense material; and subjecting the stack of thermally stable diamond table body and enriched block of dense material to a second thermal cycle within a vacuum environment causing at least some of the imbibiting material within the enriched block of dense material to migrate from the enriched block of dense material into the thermally stable diamond table body through the interface so as to join the thermally stable diamond table body to the enriched block of dense material.

19. The process according to claim 18, further comprising:

coating surfaces of the thermally stable diamond table body other than at the interface with a coating material; and coating surfaces of the enriched block of dense material other than at the interface with the coating material;

wherein the coating material prevents migration of the imbibiting material through the surfaces to which the coating material is applied.

20. The process according to claim 19, wherein the imbibiting material has properties which support locally enriching the block of dense material with binder phase by imbibition.

21. The process according to claim 20, wherein the coating material modifies kinetics of migration of the binder phase so as to create a gradual binder phase distribution.

22. The process according to claim 19, wherein the coating layer comprises a material selected from the group consisting of a boron nitride, a graphite or an aluminum oxide.

23. The process according to claim 18, wherein the dense material block is a cermet of the WC-M1 type, and wherein the imbibiting material is of the WC-M2 type, M1 and M2each being constituted by one or more metals selected from the group consisting of Co, Ni and Fe.

24. The process according to claim 18, wherein the block of dense material is a cermet block of the WC-binder type, wherein the binder material is selected from the group consisting of Co, Ni and Fe, and wherein the imbibiting material is made of the same binder material.

25. The process according to claim 18, wherein the block of dense material is a tungsten carbide block, wherein the imbibiting material is made from cobalt, and wherein the thermally stable diamond table body has been subjected to a cobalt leaching process which removes interstitial cobalt atoms, and wherein said second thermal cycle causes imbibiting material to migrate from the enriched block of dense material into the thermally stable diamond table body defining an imbibiting material gradient extending in the thermally stable diamond table body from the interface.

26. The process according to claim 18, wherein the block of dense material is a cermet, and the imbibiting material is a material which bonds the thermally stable diamond table body to the cermet by migration of imbibiting material atoms into the thermally stable diamond table body defining an imbibiting material gradient extending in the thermally stable diamond table body from the interface.

27. The process according to claim 18, wherein the interface between the bottom surface of the thermally stable diamond table body and the imbibition area surface of the enriched block of dense material is a direct surface contact interface.

28. A process, comprising:

forming a stack comprising a diamond table with a lower surface adjacent an upper surface of a dense material substrate at an interface, wherein the dense material substrate includes imbibiting material within the dense material substrate, said imbibiting material presenting a gradient extending in the enriched dense material substrate in all directions away from a core region corresponding to a portion of one of the upper or lower surfaces of the dense material substrate at the interface that is smaller than an overall area of said one of the upper or lower surfaces of the dense material substrate; and subjecting the stack to a thermal cycle causing migration of atoms of the imbibiting binder material from the dense material substrate into the diamond table through the interface so as to join the diamond table to the dense material substrate.

29. The process according to claim 28, wherein the diamond table is of a thermally stable polycrystalline diamond type, wherein a catalyst material has been leached from the diamond table, and wherein the imbibiting material is formed from that same catalyst material, and wherein said thermal cycle causes imbibiting material to migrate from the enriched dense material substrate into the diamond table defining another gradient extending in the diamond table from the interface.

30. The process according to claim 28 further comprising locally and gradually enriching the dense material substrate through the upper surface with binder phase of the imbibiting material by imbibition prior to forming the stack.

31. The process according to claim 30 wherein enriching comprises:

placing a surface of the imbibiting material into contact with the upper surface of the dense material substrate, wherein an area of the imbibiting material surface is smaller than the overall area of the upper surface of the dense material substrate; and subjecting the dense material substrate and imbibiting material to a thermal cycle which brings at least some of the imbibiting material into the liquid state for migration through an imbibition area of the dense material substrate for local and gradual enrichment of the dense material substrate presenting the gradient extending in the enriched dense material substrate in all directions away from the core region corresponding to a portion of the upper surface of the dense material substrate.

32. The process according to claim 28, wherein the dense material substrate further includes a lower surface opposite the upper surface, further comprising locally and gradually enriching the dense material substrate through the lower surface with binder phase by imbibition.

33. The process according to claim 32 wherein enriching comprises:

placing a surface of an imbibiting material into contact with the lower surface of the dense material substrate, wherein an area of the imbibiting material surface is smaller than the overall area of the lower surface of the dense material substrate; and subjecting the dense material substrate and imbibiting material to a thermal cycle including heating, temperature maintenance and cooling which brings at least some of the imbibiting material into the liquid state for migration through an imbibition area of the dense material substrate for local and gradual enrichment of the dense material substrate presenting the gradient extending in the enriched dense material substrate in all directions away from the core region corresponding to a portion of the lower surface of the dense material substrate.

34. The process according to claim 28 wherein the dense material substrate includes an enriched concentration of imbibiting material atoms at and near the upper surface of the dense material substrate, the thermal cycle causing imbibiting material atoms to migrate from the upper surface of the enriched dense material substrate into the diamond table.

35. The process according to claim 28, further comprising:

coating surfaces of the diamond table other than at the interface with a coating material;

wherein the coating material prevents migration of the imbibiting material atoms into the diamond table through surfaces to which the coating material is applied.

36. The process according to claim 28, wherein the interface between the lower surface of the diamond table and upper surface of the dense material substrate comprises a direct surface contact interface.

* * * * *